US007017735B2

(12) United States Patent
Carlson

(10) Patent No.: US 7,017,735 B2
(45) Date of Patent: Mar. 28, 2006

(54) DISPENSING CAP WITH CAPSULE FOR CONTAINER

(75) Inventor: Stephen G. Carlson, Altamonte Springs, FL (US)

(73) Assignee: The Coca-Cola Company, Atlanta, GA (US)

( * ) Notice: Subject to any disclaimer, the term of this patent is extended or adjusted under 35 U.S.C. 154(b) by 371 days.

(21) Appl. No.: 10/102,926

(22) Filed: Mar. 22, 2002

(65) Prior Publication Data

US 2002/0157971 A1 Oct. 31, 2002

Related U.S. Application Data

(63) Continuation-in-part of application No. 09/842,410, filed on Apr. 26, 2001, now abandoned.

(51) Int. Cl.
*B65D 25/08* (2006.01)

(52) U.S. Cl. ..... 206/222; 215/DIG. 8

(58) Field of Classification Search ..... 206/222, 206/219; 220/521–522; 215/6, DIG. 8
See application file for complete search history.

(56) References Cited

U.S. PATENT DOCUMENTS

| | | | | |
|---|---|---|---|---|
| 2,387,978 | A | | 10/1945 | Casey |
| 2,524,365 | A | | 10/1950 | Smith |
| 2,524,366 | A | | 10/1950 | Smith |
| 2,631,521 | A | | 3/1953 | Atkins, Jr. |
| 2,824,010 | A | | 2/1958 | Pedersen |
| 3,347,410 | A | | 10/1967 | Schwartzman ..... 222/80 |
| 3,454,177 | A | | 7/1969 | Bloom |
| 3,548,562 | A | | 12/1970 | Schwartzman ..... 53/25 |
| 3,603,469 | A | | 9/1971 | Magni |
| 3,779,372 | A | * | 12/1973 | de Lloret ..... 206/222 |
| 3,968,872 | A | | 7/1976 | Cavazza |
| 4,103,772 | A | * | 8/1978 | Wiegner ..... 206/222 |
| 4,195,730 | A | | 4/1980 | Hunt |
| 4,221,291 | A | | 9/1980 | Hunt |
| 4,615,437 | A | | 10/1986 | Finke et al. |
| 4,634,003 | A | | 1/1987 | Ueda et al. |
| 4,785,931 | A | * | 11/1988 | Weir et al. ..... 206/222 |
| 4,821,875 | A | | 4/1989 | Groves et al. |
| 4,836,370 | A | * | 6/1989 | Bosshard ..... 206/222 |
| 4,982,875 | A | | 1/1991 | Pozzi et al. |
| 5,038,951 | A | | 8/1991 | Rizzardi |
| 5,255,812 | A | | 10/1993 | Hsu |
| 5,517,804 | A | | 5/1996 | Lynch |
| 5,714,186 | A | | 2/1998 | Nash et al. |

(Continued)

*Primary Examiner*—Bryon P. Gehman
(74) *Attorney, Agent, or Firm*—Finnegan, Henderson, Farabow, Garrett & Dunner LLP

(57) ABSTRACT

A cap for use with a container includes a ring member having an opening and a capsule provided on the ring member. The capsule extends through the opening. A plunger is provided on an interior wall of the capsule. The capsule contains a substance, such as a water-dispersible liquid. The container having a main chamber and a mouth stores and serves a beverage. The main chamber is filled with a single strength beverage, and the capsule is filled with a water-dispersible liquid. The liquid may be a flavor such as, for example, citrus, cranberry, passion fruit, or carambola. The capsule is placed in the mouth of the container contiguous the main chamber, with the capsule being openable to inject the water-dispersible liquid into the single strength beverage in the main chamber in response to manual manipulation of the capsule.

46 Claims, 2 Drawing Sheets

U.S. PATENT DOCUMENTS 5,772,017 A 6/1998 Kang
5,884,759 A * 3/1999 Gueret ..... 206/222
5,927,549 A 7/1999 Wood
5,941,380 A 8/1999 Rothman
5,971,140 A 10/1999 Frutin
5,979,647 A 11/1999 Han
6,092,648 A 7/2000 Sellars
6,152,296 A 11/2000 Shih ..... 206/222

* cited by examiner

DISPENSING CAP WITH CAPSULE FOR CONTAINER

This application is a continuation-in-part of prior application Ser. No. 09/842,410, filed Apr. 26, 2001 now abandoned. This application is being filed under the provisions of 37 C.F.R. § 1.53(b).

FIELD OF THE INVENTION

The present invention relates to a cap for a beverage container. More particularly, the present invention relates to a dispensing cap that facilitates injection of a substance, including one or more of a flavoring extract, a coloring, a vitamin, and a micronutrient, for example, into a beverage matrix within a container.

BACKGROUND OF THE INVENTION

Generally, flavor systems developed for moderate to high acid containing single strength citrus beverages stored at ambient temperatures deteriorate relatively quickly, i.e., they have a limited shelf-life. While the invention is primarily used with glass containers, certain plastic and metal containers also may be used, so long as they can withstand pasteurization temperatures (180° F.). PET, aluminum, and steel are examples of plastic and metal containers. Orange juice, grapefruit juice, lemonade, and limeade are examples of moderate to high acid containing beverages. Other moderate FINNEGAN to high acid beverages may include cranberry, passion fruit, and carambola.

Similarly, other beverage additives may cause a degradation in flavor of the beverage if the beverage is stored at ambient temperatures for a prolonged period of time. Furthermore, it may be desirable for a beverage producer to market a product in a particular manner, for example, with a particular color or texture. Consequently, it may be desirable to package a beverage container such that a beverage additive is kept separate from a beverage matrix until a time of consumption. Further, it may be desirable to package the beverage additive separate from the beverage matrix to afford a consumer the decision whether to combine the additive with the matrix.

Shelf-life can be broadly defined as the length of time between initial packaging of a product and the point at which consumers notice a decrease in product quality. Thus, shelf-life of a product is determined by the least stable aspect of that product or its package. For moderate to high acid-containing single strength citrus beverages, the least stable aspect, as well as the cause of greatest flavor degradation, is extended contact of the favoring extract with acids contained within a beverage matrix. For example, b-pinene, a terpene found in citrus oils, is altered during storage by its contact with beverage containing citric acid, through the process of acid catalyzed hydrolysis, into one or more undesirable compounds.

Conventional citrus-based flavor systems developed to withstand ambient storage in moderate- to high-acid hot-packed beverages are at best compromises.

These flavor systems do not impart the fresh, well-balanced characterizing aroma and flavor of the citrus for which the beverage is named. Although they are more stable than other conventional flavor systems that are considered fresher from a taste and/or aroma standpoint, the compromised flavor systems soon begin to degrade themselves, although at a slower rate. In actuality, no ambient shelf stable flavor systems exist for moderate to high acid citrus flavored beverages, particularly those stored in glass containers. While the invention is primarily used with glass containers, certain plastic and metal containers also may be used, so long as they can withstand pasteurization temperatures (180° F.). PET, aluminum, and steel are examples of plastic and metal containers.

For flavoring citrus-based products, the most organoleptically fresh and fruit-characterizing flavored beverages include the extracts made from essential citrus oils and other water-dispersible liquid flavors such as cranberry, passion fruit, and carambola. These citrus and other flavors are manufactured in a manner so as to be completely dispersible in single strength, non-flavored beverages. While the water-dispersible liquid citrus flavors are fresh in both aroma and flavor, they tend to be the least stable flavor systems for use in moderate to high acid single strength citrus fruit juices or citrus fruit drinks. The stability of water-dispersible liquid citrus flavor can, when used to flavor high acid beverage matrixes, be measured in days as opposed to weeks or months for the more stable citrus beverage flavor systems.

Conventional caps and other conventional container closures sometimes include a reservoir for maintaining one component separate from a second component contained within a container. The reservoir is typically formed in the cap or closure. At a later time, the components can be combined. Such conventional caps and closures may include an opener for causing the reservoir to open so that the components can be combined. However, this technology heretofore has not been used to improve the shelf-life of citrus beverages.

SUMMARY OF THE INVENTION

According to one aspect of the invention, a cap for use with a container includes a ring member having an opening, a capsule provided on the ring member and extending through the opening, a plunger provided on an interior wall of the capsule, and a substance, for example, a liquid or a solid, contained within the capsule.

According to another aspect, the capsule includes a scored rupture point at its bottom apex. When the container is positioned upright, the substance, for example, a liquid substance, rests above this point and interfaces with the capsule headspace above. The capsule headspace, bound between the substance and the capsule top wall, contains nitrogen at a pressure greater than that existing in the beverage headspace located directly below the capsule bottom wall and rupture point.

According to another aspect of the invention, a method of storing a beverage includes filling a container to a predetermined level with a flavored or unflavored single strength beverage and filling a capsule with a predetermined amount of a water-dispersible substance. Thus, when the capsule is ruptured, the water-dispersible substance will be ejected from the capsule and through the ruptured orifice, by capsule nitrogen pressure, into communication with the single strength beverage below.

According to another aspect of the invention, a method of storing a beverage includes filling a container to a predetermined level with a single strength beverage and filling a capsule with a predetermined amount of a water-dispersible substance such as a liquid flavoring, for example, citrus, cranberry, passion fruit, carambola, or such flavor. The capsule can be opened into fluid communication with the container. The method also includes flushing and maintaining the capsule headspace with nitrogen at a pressure greater than that of the beverage container headspace. In glass and rigid plastic bottles and metal containers, such as those made from PET, aluminum and steel, the beverage container headspace is normally under less than atmospheric pressure, i.e., a slight partial vacuum. Accordingly, in such a beverage container where the headspace is maintained at a slight partial vacuum and where the capsule headspace is at, or very slightly above atmospheric pressure, water-dispersible liquid injection into the single strength beverage is enhanced.

In one embodiment, when the capsule is opened into fluid communication with the container, the pressure of the nitrogen in the headspace assists ejection of the water-dispersible liquid through the rupture point at the bottom apex of the capsule. After injecting the water-dispersible liquid into the single strength beverage, one manner for mixing the two components is through shaking, rather than through a forceful propulsion of the liquid into the beverage that results in turbulent mixing. As another alternate embodiment, the turbulent mixing could be brought about by an appreciably higher capsule headspace pressure. However, since one mode of mixing is through a lower pressure (i.e., at or slightly above atmospheric pressure) injection followed by manual shaking, the capsule may be provided with a plunger to at least assist with opening the capsule.

According to another aspect of the invention, a method of improving shelf-life of packaged beverages, for example, citrus beverages, includes providing a container for storing and serving the beverage where the container has a main chamber and a mouth. The method also includes filling the main chamber with a single strength beverage, for example, a non-flavored single strength beverage, and filling a capsule with a water-dispersible liquid, for example, a flavor. Further, the method includes placing the capsule in the mouth of the container contiguous the main chamber, with the capsule being openable to inject the water-dispersible liquid into the single strength beverage in the main chamber in response to manual manipulation of the capsule.

According to yet another aspect of the invention, a container for beverages that enhances the shelf-life thereof includes a main chamber fillable with a single strength beverage, for example, a non-flavored single strength beverage, and a capsule in a mouth of the container contiguous the main chamber fillable with a water-dispersible liquid, for example, a citrus flavor. The container also includes an actuation device for propelling water-dispersible liquid from the capsule into the single strength beverage with sufficient force to cause turbulent mixing.

In a preferred embodiment, a water-dispersible liquid, for example, a flavor, may be isolated from the non-flavored single strength beverage during the storage period, i.e., from the time of manufacture to consumption. Thus, the stability of the flavor system quality would not be adversely affected during the storage period, as would a non-isolated flavor system. After injecting the flavor into the beverage, one manner for mixing the two components is through shaking, rather than through a forceful propulsion of the extract into the matrix that results in turbulent mixing. In this mode, a low pressure (i.e., at or slightly above atmospheric pressure) injection is followed by shaking. As another alternative embodiment, turbulent mixing could be brought about by an appreciably higher capsule headspace pressure. According to another embodiment, the turbulently-mixed water-dispersible liquid and single strength beverage may be further mixed by shaking the container. According to one aspect, the capsule containing the water-dispersible liquid is oriented within the container such that its contents can be injected into the single strength beverage easily and safely from outside of the glass container. Once the liquid and beverage are mixed and the container opened, the beverage may be consumed in the same manner as would any other juice or non-juice containing beverage.

It is to be understood that both the foregoing general description and the following detailed description are exemplary and explanatory only and are not restrictive of the invention, as claimed.

The accompanying drawings, which are incorporated in and constitute a part of this specification, are included to provide a further understanding of the invention. The drawings illustrate one embodiment of the invention and, together with the description, serve to explain the principles of the invention.

DESCRIPTION OF THE PREFERRED EMBODIMENTS

Reference will now be made in detail to the present preferred embodiments of the invention, an example of which is illustrated in the accompanying drawings. Wherever possible, the same reference numbers will be used throughout the drawings to refer to the same or like parts.

Figure 1:
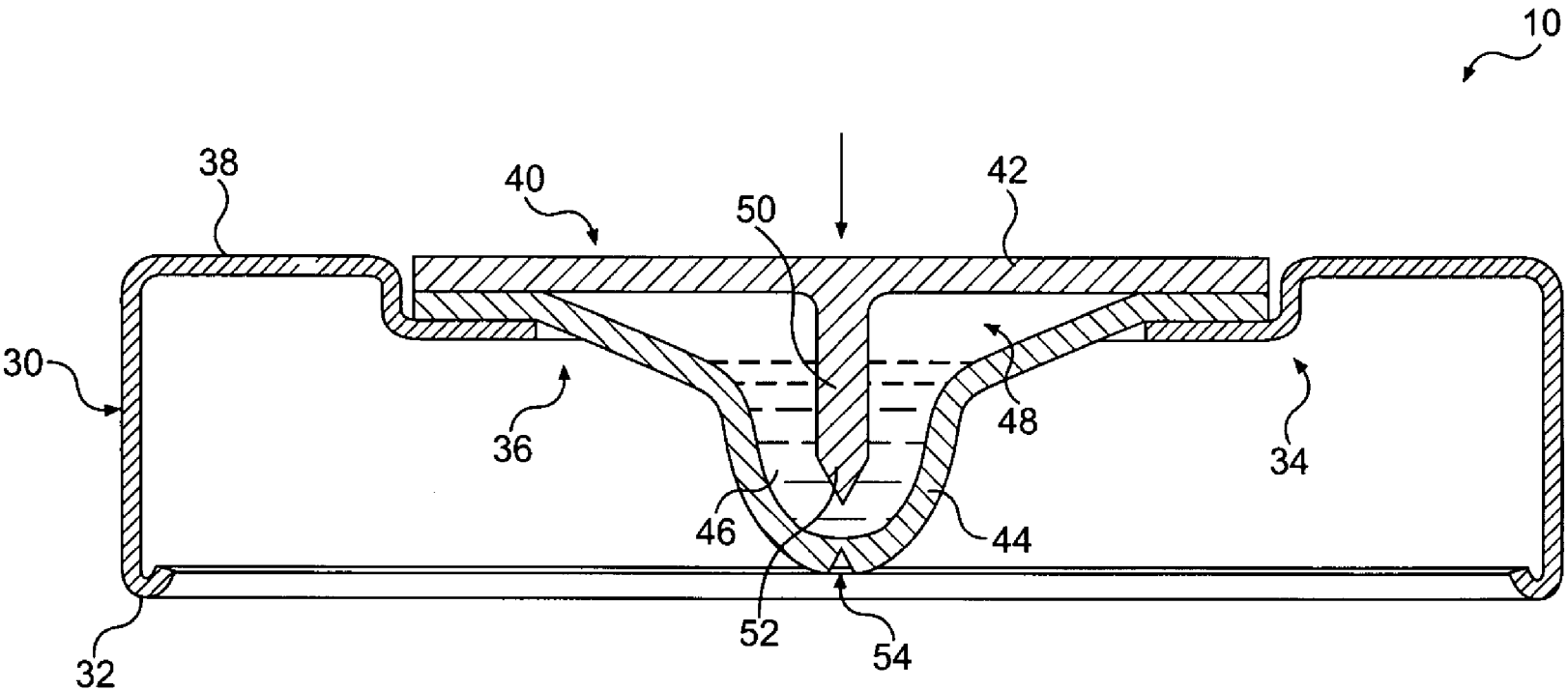
FIG. 1 is a side, cross-sectional view of a dispensing cap according to one preferred embodiment of the invention.

The exemplary embodiment of the dispensing cap of the present invention is shown in FIG. 1 and is designated generally by reference numeral 10.

Figure 2:
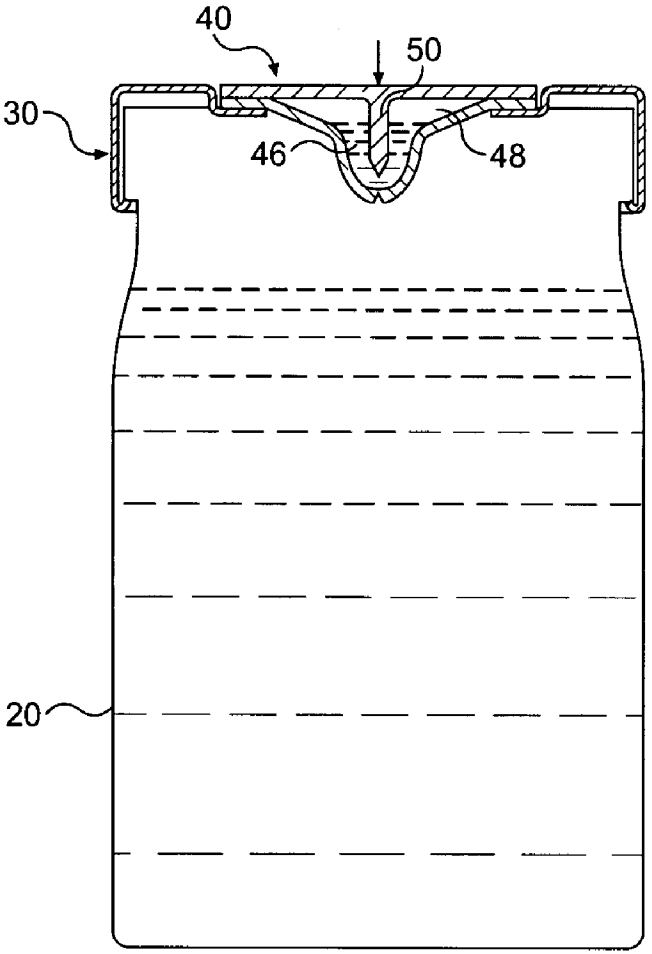
FIG. 2 is a side, cross-sectional view of a beverage container including the dispensing cap shown in FIG. 1.

As embodied herein and referring to FIGS. 1 and 2, a cap 10 for use with a container 20 (shown in FIG. 2), preferably a beverage container, includes a closure ring 30 and a capsule 40. The closure ring 30 sealingly closes the container 20 from ambient air. The closure ring 30 may include a curved bottom end 32 for securing the closure ring 30 with threads or partial threads (not shown) on the container 20. Alternatively, the closure ring 30 may include threads or partial threads complementary to the threads or partial threads on the container 20.

Figure 3:
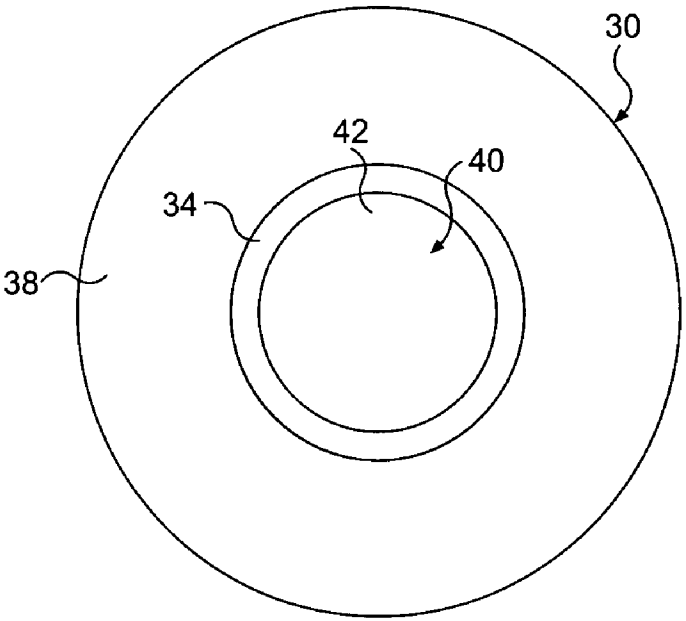
FIG. 3 is a top view of the dispensing cap shown in FIG. 1.

In the preferred embodiment shown in FIG. 1, the closure ring 30 includes a recessed portion 34 and an opening 36. As shown in FIG. 1, the recessed portion 34 is preferably of a depth such that a top wall 42 of the capsule 40 is substantially flush with the non-recessed portion 38 of the closure ring 30. However, the recessed portion 34 may be more or less recessed, if desired. The opening 36 may be substantially centered on the closure ring 30 as shown in FIG. 3, or it may be radially shifted.

As illustrated in FIG. 1, the capsule 40 is preferably provided in the recessed portion 34 of the closure ring 30. In the preferred embodiment shown in FIG. 1, the capsule 40 includes two sections, the top wall 42 and a nozzle-shaped section 44. The two sections 42, 44 are sealed together to form the capsule 40. The sections 42, 44 may be heat sealed, sonically sealed, adhesively sealed, or the like. The top wall 42 and nozzle-shaped section 44 may be formed by molding, extrusion, or the like.

The capsule 40 contains a water-dispersible substance 46 and a headspace 48. The capsule 40 may contain, for example, a flavor such as citrus, cranberry, passion fruit, as well as other delicate flavors. Additionally or alternatively, the capsule may contain, for example, one or more of a color, a vitamin, a micronutrient. The color may comprise a Food, Drug & Cosmetics (FDC) color, for example, yellow #5, yellow #6, blue #1, red #40, and the like, or any and all combinations of FDC colors. The headspace 48 preferably contains inert nitrogen gas since it affords protection from quality degradation of a water-dispersible liquid. Other gases such as oxygen cause degradation in the quality of a water-dispersible liquid. For example, oxygen may cause degradation in the flavor quality of a water-dispersible liquid flavor.

In a preferred embodiment, as shown in FIG. 1, an inner surface of the top wall 42 of the capsule 40 includes a plunger 50. The plunger 50 can assist opening of the capsule 40 into fluid communication with the container 20. The plunger 50 preferably includes a tapered end 52. The end 52 may be more or less tapered than that shown in FIG. 1. Furthermore, the plunger 50 could have a squared end, a rounded end, or the like instead of a tapered end.

Also, as shown in FIG. 1, the capsule preferably includes a scored region at its bottom apex 54. The scored region 54 facilitates opening of the capsule 40 into fluid communication with the container 20. However, it should be appreciated that the capsule does not require a scored region to be openable.

A container with a cap, such as that shown in FIG. 2, can be used to store a beverage. The container is filled to a predetermined level with a first, a component of a beverage. According to one aspect, the first component may be any or non-flavored single strength diluent, such as, for example, water, carbonated water, fruit or vegetable juice-containing beverages. According to another aspect, the first component may be a flavored beverage such as, for example, COCA-COLA, SPRITE, DIET COKE, tea, juice, or the like.

The cap 10 includes a capsule 40, which may be formed from a plurality of sections that can be sealed together. The capsule 40 is filled with a predetermined amount of a water-dispersible substance 46. According to one embodiment, the water-dispersible substance 46 may comprise a liquid flavor derived from an essential oil of citrus origin, for example, orange, grapefruit, or lemon. However, the capsule 40 may be filled with cranberry, passion fruit, carambola, or other delicate water-dispersible flavorings. According to another embodiment, the water-dispersible substance 46 may comprise a color, a vitamin, or a micronutrient. Alternatively, the water-dispersible substance may comprise a solid substance such as, for example, a dissolvable powder or granular substance. The capsule 40 also includes a headspace 48. In one embodiment, the capsule headspace, prior to sealing, is flushed and pressurized with nitrogen at a pressure only slightly greater than atmospheric pressure.

The container is sealed for storage by the cap, including the capsule. The water-dispersible substance 46 remains isolated from the first component, the single strength beverage. This arrangement is preferably maintained until just before consumption of the beverage. When a person desires to consume the beverage, that person applies a force to the capsule top such that the scored region at the bottom apex of capsule ruptures and propels the water-dispersible substance into the first component, the single strength beverage.

The capsule may be provided with a plunger on its inner surface to assist with rupturing the capsule. In addition, the capsule may include a scored region to facilitate rupturing.

One manner for mixing the water-dispersible substance and the single strength beverage is through a low pressure (i.e., at or slightly above atmospheric pressure) injection followed by shaking. However, with higher pressures of nitrogen a forceful propulsion of a liquid into the matrix may result in turbulent mixing. Thus, the turbulent mixing could be brought about by an appreciably higher capsule headspace pressure. In another aspect, the turbulent mixing may be followed by shaking.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

I claim:

1. A cap configured to removeably engage a container, comprising:

a ring member having a side wall and a top wall extending substantially radially from the side wall so as to define an opening;

a capsule extending through the opening, the capsule having a top wall extending substantially planar with an uppermost portion of the top wall of the ring member and a bottom wall connected to the top wall of the ring member;

a plunger provided on an interior surface of the top wall of the capsule; and a substance contained within the capsule.

2. The cap according to claim 1 wherein the side wall of the ring member defines a side periphery of the ring member and the top wall of the ring member defines a top periphery of the ring member.

3. The cap according to claim 1 wherein the capsule includes a bottom end containing a water-dispersible liquid and a headspace containing an inert gas at atmospheric pressure.

4. The cap according to claim 3, wherein the pressure of the inert gas in the headspace is sufficient to assist in ejecting the water-dispersible liquid through a rupture in the bottom end.

5. The cap according to claim 3, wherein the inert gas is nitrogen.

6. The cap according to claim 1 wherein the capsule includes a bottom end containing a water-dispersible liquid and a headspace of inert gas at a pressure slightly above atmospheric pressure.

7. The cap according to claim 6, wherein the inert gas is nitrogen.

8. The cap according to claim 6, wherein the pressure of the inert gas in the headspace is sufficient to assist in ejecting the water-dispersible liquid flavor through a rupture in the bottom end.

9. The cap according to claim 1 wherein the capsule includes a bottom end containing a water-dispersible liquid and a headspace of inert gas at a pressure much greater than atmospheric pressure.

10. The cap according to claim 9, wherein the inert gas is nitrogen.

11. The cap according to claim 9, wherein the pressure of the inert gas in the headspace is sufficient to assist in ejecting the water-dispersible liquid flavor through a rupture in the bottom end.

12. The cap according to claim 1 wherein the plunger is configured to rupture the capsule upon application of a force to the capsule.

13. The cap according to claim 1 wherein the capsule includes a bottom end containing a water-dispersible liquid, said bottom end comprising a scored region for facilitating rupture of the capsule.

14. The cap according to claim 1 wherein the capsule contains a water-dispersible liquid and a headspace containing inert gas.

15. The cap according to claim 14, wherein the water-dispersible liquid comprises at least one of a flavor, a color, a vitamin, and a micronutrient.

16. The cap according to claim 14, wherein the water-dispersible liquid comprises at least one of orange, grapefruit, lemon, cranberry, passion fruit, and carambola.

17. The cap according to claim 14, wherein the water-dispersible liquid comprises an essential oil of citrus origin.

18. The cap according to claim 1 wherein the capsule includes a nozzle end having a scored rupture point.

19. The cap according to claim 1, wherein the substance is from the group consisting of citrus, cranberry, carambola, or passion fruit.

20. The cap according to claim 1, wherein the capsule is substantially contained within the volume defined by the interior of the ring member.

21. The cap according to claim 1, wherein the top wall of the capsule is disc shaped.

22. The cap according to claim 1, wherein the bottom wall of the capsule is connected to the top wall of the ring member by any one of a heat, sound, or adhesive seal.

23. The cap according to claim 1, wherein the bottom wall of the capsule includes an outer portion connected to an inner portion of the top wall of the ring member.

24. The cap according to claim 1, wherein the bottom wall of the capsule includes an inner surface connected to an outer surface of the top wall of the ring member.

25. The cap according to claim 1, wherein the top wall of the capsule is configured to move between a substantially planar shape and a bowed shape.

26. The cap according to claim 1, wherein the top wall of the ring member includes a non-recessed portion and a recessed portion connected to the bottom wall of the capsule.

27. The cap according to claim 26, wherein the recessed portion of the top wall of the ring member is configured such that the top wall of the capsule is substantially flush with the non-recessed portion of the top wall of the ring member.

28. The cap according to claim 1, wherein the top wall of the ring member is configured such that the top wall of the capsule is substantially flush with an outermost portion of the top wall of the ring member.

29. The cap according to claim 1, wherein the top wall of the ring member is configured such that the bottom wall of the capsule is spaced inwardly from an outermost portion of the top wall of the ring member.

30. A container for beverages flavored with delicate water-dispersible liquid flavors for enhancing shelf-life thereof, the container comprising:

a main chamber fillable with a beverage; and the cap according to claim 1, wherein said substance is a water-dispersible liquid flavor.

31. The container of claim 30 wherein the water-dispersible liquid flavor is citrus flavor.

32. The container of claim 30 wherein the water-dispersible liquid flavor is from the group consisting of citrus, cranberry, passion fruit, and carambola.

33. The container of claim 30 wherein the capsule includes a bottom end containing the water-dispersible liquid flavor and a headspace of inert gas at a pressure slightly above atmospheric pressure.

34. The container of claim 30 wherein the capsule includes a bottom end containing the water-dispersible liquid flavor and a headspace of inert gas at a pressure much greater than atmospheric pressure.

35. The container of claim 30, wherein the capsule contains at least one of a color, a vitamin, and a micronutrient.

36. A cap for removeably engaging a container, comprising:

a ring member having a side wall and a top wall extending substantially radially from the side wall;

a capsule having a top wall configured to move between a first position, where the top wall is in a substantially planar shape, and a second position, where the top wall is in a substantially bowed shape, and a bottom wall having a first portion connected to the top wall of the capsule and a second portion connected to the top wall of the ring member;

a substance contained within the capsule; and wherein the capsule is configured to release the substance contained within the capsule when the top wall of the capsule is moved to the second position.

37. The cap according to claim 36, wherein the capsule is substantially contained within the volume defined by the interior of the ring member.

38. The cap according to claim 36, wherein the capsule includes a plunger extending from an inner surface of the top wall.

39. The cap according to claim 36, wherein the first portion of the bottom wall comprises an upper side and the second portion of the bottom wall comprises a lower side.

40. The cap according to claim 36, wherein the top wall of the capsule extends substantially planar with the top wall of the ring member when the top wall of the capsule is in the first position.

41. The cap according to claim 36 wherein the capsule includes a bottom end containing a water-dispersible liquid and a headspace containing a pressurized inert gas.

42. The cap according to claim 41, wherein the water-dispersible liquid comprises at least one of a flavor, a color, a vitamin, and a micronutrient.

43. The cap according to claim 36, wherein the second portion of the bottom wall of the capsule is connected to the top wall of the ring member by any one of a heat, sound, or adhesive seal.

44. The cap according to claim 36, wherein the top wall of the ring member includes a non-recessed portion and a recessed portion connected to the second portion of the bottom wall of the capsule.

45. The cap according to claim 44, wherein the recessed portion of the top wall of the ring member is configured such that the top wall of the capsule is substantially flush with the non-recessed portion of the top wall of the ring member.

46. The cap according to claim 36, wherein the top wall of the ring member is configured such that the bottom wall of the capsule is spaced inwardly from an outermost portion of the top wall of the ring member.

* * * * *